United States Patent [19]

Silverberg

[11] 4,043,655

[45] Aug. 23, 1977

[54] PHOTOELECTROPHORETIC IMAGE REPRODUCTION DEVICE

[75] Inventor: Morton Silverberg, Rochester, N.Y.

[73] Assignee: Xerox Corporation, Stamford, Conn.

[21] Appl. No.: 382,809

[22] Filed: July 26, 1973

Related U.S. Application Data

[60] Division of Ser. No. 349,498, April 9, 1973, which is a continuation of Ser. No. 114,794, Feb. 12, 1971, abandoned, which is a division of Ser. No. 746,177, July 19, 1968, Pat. No. 3,607,256.

[51] Int. Cl.[2] ..... G03G 15/00; G03G 17/04

[52] U.S. Cl. ..... 355/3 P; 204/180 R; 204/181; 204/299 R

[58] Field of Search ..... 204/181 PE, 299 PE, 204/300 PE; 96/1 PE, 1.3; 355/3 P, 4, 5

[56] References Cited

U.S. PATENT DOCUMENTS

| | | | |
|---|---|---|---|
| 3,384,565 | 5/1968 | Tulagin et al. | 204/181 |
| 3,511,651 | 5/1970 | Rosenberg | 204/181 |
| 3,689,399 | 9/1972 | Ota | 204/181 |

*Primary Examiner*—Arthur C. Prescott

*Attorney, Agent, or Firm*—James J. Ralabate; Richard A. Tomlin; Gaetano D. Maccarone

[57] ABSTRACT

A photoelectrophoretic image reproduction device wherein a suspension of electrically photosensitive particles in a fluid is provided between two transparent conductive plates. Exposure of the suspension to a light image while field is applied between the plates causes the formation of a viewable image by particles depositing in imagewise configuration on the plates. A dark suspension fluid may be used.

9 Claims, 6 Drawing Figures

PHOTOELECTROPHORETIC IMAGE REPRODUCTION DEVICE

CROSS-REFERENCE TO RELATED APPLICATIONS

This application is a Divisional of Application Ser. No. 349,498, filed Apr. 9, 1973. Application Ser. No. 349,498 is a Continuation of Ser. No. 114,794, filed Feb. 12, 1971, now abandoned which application is a Divisional of application Ser. No. 749,177, filed July 19, 1968 now U.S. Pat. No. 3,607,256.

BACKGROUND OF THE INVENTION

Apparatus for reproducing images, and in particular, apparatus for the direct reproduction of images by utilizing a light sensitive element, a developer powder and an electric field has been known in the past. In the aforementioned apparatus, light rays are transmitted through an image copy and pass through a glass plate having a conductive coating thereon. The resistance of a photoconductive element adjacent the conductive coating becomes reduced and charges the developer power lying upon the illuminated areas of the conductive coating. The electric field thereupon attracts the charged developer powder and the particles migrate from the conductive coating leaving a visible powder image thereon. The developer powder particles can be suspended in a liquid medium, as well as in air or a vacuum.

The size limitations of the prior art apparatus, the difficulty of removing undeposited particles between the plates, the relative complexity of the apparatus and the required viewing optics made it advantageous to consider alternatives.

SUMMARY OF THE INVENTION

The invention deals with systems utilizing sealed particle migration systems to produce temporary image buffers. A temporary image buffer is defined as a system which responds to a light image by forming a viewable image. The viewable image is capable of being stored indefinitely if desired and being erased on demand, thereby being suitable for reuse. The image buffers of the present invention have possible uses as viewing screens for microimage viewers, display panels and as intermediates for electronic graphic communications systems, display projection systems and imaging systems. The circulation system used in conjunction with the temporary image buffer serves to provide clear fluid during the viewing process and for imparting a sideways component of force to the particles rejected from an illuminated area.

An object of this invention is to provide a display system designed to respond to selective or imagewise exposure by forming a viewable image.

Another object of the invention is to provide sealed particle migration display systems designed to respond to selective or imagewise exposure by forming a viewable image of the type enabling either indefinite storage or erasure.

It is a further object of the invention to provide a particle migration imaging cell together with a fluid circulation system, the fluid circulating system providing clear fluid during the viewing process and providing a sideways component of force to the particles rejected from an illuminated area.

It is still a further object of the present invention to provide novel techniques for viewing the images formed within the particle migration imaging cell.

For a more complete understanding of the invention, the above listed objects and other aspects of the invention will be further explained in the following detailed description in conjunction with the drawings.

DESCRIPTION OF THE PREFERRED EMBODIMENTS

Figure 1A:
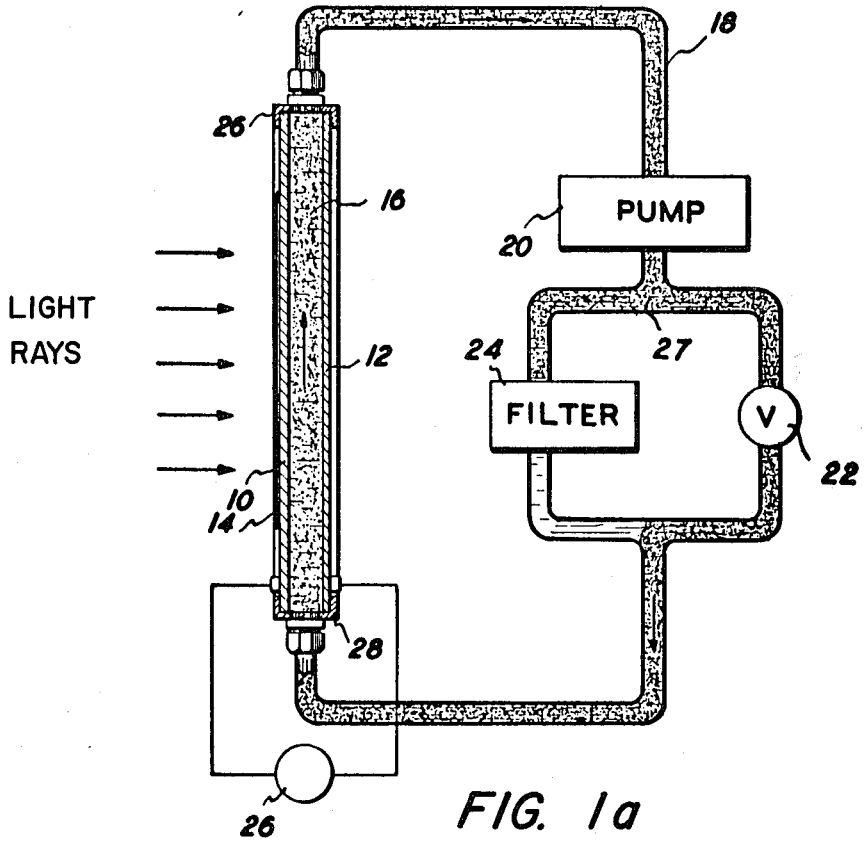
FIG. 1*a* is a block diagram of the display and circulation systems of the present invention.

Referring now to FIG. 1*a*, there is shown a block diagram of the system of the present invention.

NESA plates 10 and 12, marketed by the Pittsburgh Plate Glass Company and comprising a transparent conducting tin oxide coating overlaying a glass substrate, are shown slightly separated from one another by fluid 16, flowing in the direction of the arrows. The plate 10 and 12 and the portion of the fluid 16 therebetween are completely sealed. Fluid 16 carries a dilute suspension of particles. The fluid may be air, although an appropriate high breakdown voltage liquid is preferable. The fluid within the plates 10 and 12 is delivered to pump 20 via tube 18. The output of pump 20 initially is passed through open valve 22 and returned to the enclosed plate assembly. A source of voltage 26 is shown connected between plates 10 and 12 and produces an electric field therebetween. Structures 28 serve to align and support the enclosed assembly.

In one embodiment the system operation will be considered when the particles in suspension are photoconductive and in addition are dark and bipolar, such as selenium or phthalocyanine. Examples of additional photosensitive particles which may be utilized in the present invention are disclosed in U.S. Pat. No. 3,383,993 issued May 21, 1968. A light image is focused into the space between plates 10 and 12 by transmitting light rays through, or reflective from, any optically visible subject 14 such as a film, picture, text, drawing or surface area placed adjacent the outer surface of plate 10. Source 26 establishes an electric field between the conducting layers of plates 10 and 12 simultaneously with the projection of the light image and valve 22 is then opened. to permit the particle carrying liquid 27 to circulate through the system. As illustrated schematically in the figure, with the valve open, the fluid flow is through the valve 22. The particles, due to either their bipolar characteristics or their initial charge, will deposit on the inner surfaces of plates 10 and 12. Due to the properties of the optical visible object, only certain portions of the inner plates will be irradiated by light. Since the particles in this embodiment are photoconductive, the particles adjacent to the irradiated portions of the inner plates will have their resistance reduced due to their photoconductive characteristic. The selenium particles assume the charge of the surface with which they are in contact and the electric field between the plates causes the charged selenium particles to be repelled and migrate to the dark inner surfaces of plates 10 and 12. In the inner surface dark areas the particles adhere thereto due to their being charged in a polarity opposite to that of the charged plates or to their bipolar characteristic.

Figure 1B:
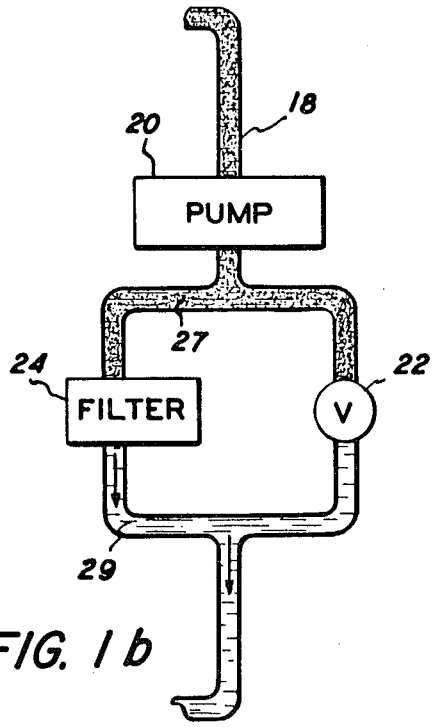
FIG. 1*b* illustrates a portion of the circulation system operative during the viewing process.

After the fluid suspension has been circulated for an appropriate time, valve 22 is closed and the fluid circulation must now pass through filter 24 as illustrated schematically in FIG. 1*b*. Particles which may have remained in the fluid 27 after illumination and have not been deposited will be removed by filter 24 and be replaced with clear fluid 29. Following this operation, pump 20 is stopped and the voltage potential 26 between the plates removed. The resulting charge pattern is that shown in FIG. 2 wherein the particles remaining on the inner surfaces of plates 10 and 12 correspond to the dark images on the visual object and wherein the areas devoid of particles deposited on the inner surfaces correspond to the light areas. The rear illumination system 30 is then turned on and the exposed areas will show up as bright areas when viewed through the front surface of plate 10. Thus, this embodiment will produce positive images.

Erasure is accomplished by reapplying the voltage differential while maintaining the rear illumination on, opening valve 22 and turning on pump 20. The combination of the electrostatic field and the illumination flooding causes the deposited particles to become redistributed and ready for imaging. The particles initially stopped by filter 24 are also redistributed in the fluid. The rear illumination system can now be turned off and the image buffer is ready to accept a new input. In order to facilitate the removal and redistribution of the deposited particles, it may also be necessary to apply a low frequency, large amplitude voltage source to the plates and/or ultrasonic energy to the fluid between the plates. If necessary, a mechanical scraper system can be utilized.

The circulation system comprising pump 20, valve 22, and filter 24 serves two functions. The first one is to provide clear fluid during the viewing process if the particles are not completely deposited and to provide a sidewise component of force to the particles rejected from an illuminated area.

The enclosed assembly can be image exposed and viewed from the same side or image exposed from one side and viewed from the other side. In the first situation, if the assembly is shielded from ambient illumination during the exposure step, the preceding details are sufficient. If however, the assembly is exposed from one side and viewed from the other, the ambient illumination must be prevented from reaching the particles during the exposure step. This can be achieved by working in a dark room, covering the front face of plate 10 during image exposure or selecting particles which respond (become conductive) upon exposure to a given portion of the illumination spectrum such as ultraviolet and placing a filter in front of the front surface of plate 10 which does not pass this portion of the spectrum.

The display portion of the imaging system can be arranged so that it may be removed from the circulation system and the supporting structure 28, enabling the image to be stored or viewed by an appropriate projection device.

Surface reflections from the plate may be reduced, for example, by etching the front surface of plate 10 and making the sheet 10 thin to minimize possible image blurring effects.

In another embodiment of the invention, the particles in suspension are light in color, photoconductive and nonpolar, such as zinc oxide. Examples of additional photosensitive particles which may be utilized in the present embodiment are also disclosed in the aforementioned U.S. Pat. No. 3,383,993. Since the particles are nonpolar, they would not normally be attracted to either of the inner plate surfaces 10 or 12. The paticles can be charged prior to image exposure by providing a section in the flow path in which the particles are illuminated and then brought into contact with the conducting portions of the plates or possibly by flooding the plate with light prior to the exposure. This precharging process is not limited to use with light particles but is also applicable to dark particles such as selenium.

When the white particles are used in the system such as described previously, the rear illumination system is not used for viewing. The interior recesses of the system are preferably light absorbing and the areas on the plate which have been struck by light appear dark. Thus, this system is a negative process. The requirements for control of the ambient illumination are the same as before and the same solutions are applicable. An additional feature might be to coat the rear surface of plate 12 with a dark coating which transmits a portion of the spectrum used for image exposure. An opaque coating can be used for a front exposure system. This eliminates the need for a light absorbing cavity behind plate 10.

In another embodiment of the invention, the input image will be entered over a period of time, as from a cathode ray tube display, for example, as opposed to a slide transparency. For this embodiment nonpolar particles are preferred. The initial operation consists of charging all the particles entering the space between the plates while maintaining a potential difference between them. This is done without any illumination on the panel. Thus all the particles should deposit on one of the inner surfaces of plates 10 and 12. However, the polarity should be arranged so that the particles deposit on the inner surface of the front plate 10. Following this initial step, two exposure/development sequences are significant. In the first, the potential difference between plates 10 and 12 is reduced to a lower value. This lower potential difference is chosen so that during the image exposure, the particles do not transfer although the attraction (repulsion) forces developed in the exposed areas will be in this direction. After the assembly has been image exposed, the potential difference is raised and the light struck particles will be transferred to the inner surface of plate 12.

If the transfer time between inner surfaces is slower than the elemental exposure time either due to a slow transfer process (due to substantial separation between the electrodes, high suspension fluid viscosity, etc.) or the elemental exposure time is brief the voltage potential does not need to be lowered. The constraint of lower voltage during exposure resulted from wishing to avoid the possibility of the particles reaching the opposite surface while they are still illuminated, charging to the potential of this electrode and returning to the front plate. It should be noted that since it is unlikely that all the particles returning to the original plate would return to the empty areas, then under some circumstances this blurring condition would be acceptable.

An alternate exposure and development step involves using the reduced voltage during exposure but the particle transfer is accomplished by reversing the potential between the electrodes and causing the particles which were not struck by light to transfer to the other plate.

Figure 3:
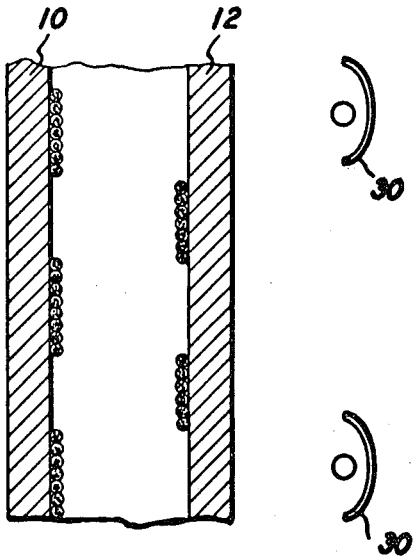

In either of the above sequences, the particle distribution is as shown in FIG. 3. The potential difference between the two plates is reduced to zero to avoid image disturbance by the viewing illumination. The image can be viewed by either rear illumination using dark particles or with front illumination using reflective particles. When large solid areas are transferred to rear inner surface 12, they tend to interfere with the viewing process. A possible method of overcoming this interference includes a frosted light scattering surface on the inner front surface using dark particles or a dark suspension fluid (which in the case of rear imaging is transparent to the imaging spectrum) for a reflective particle system.

Figure 2:
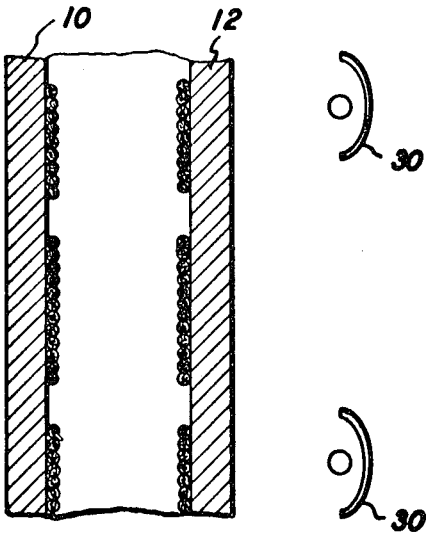
FIGS. 2 and 3 illustrate a portion of the display panel cell after imaging has occurred and produced by various embodiments of the invention.
Figure 4A:
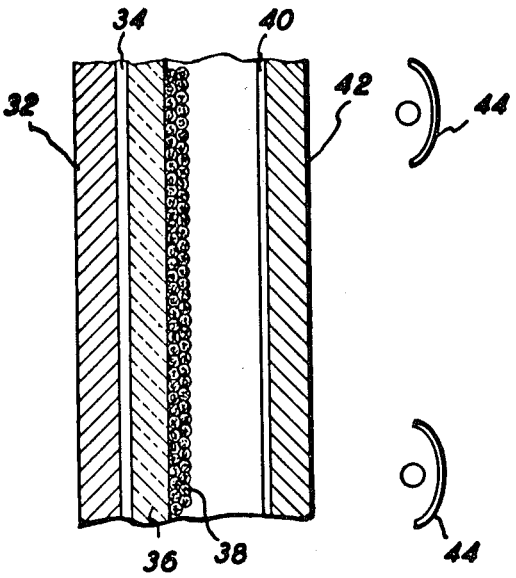
FIGS. 4*a* and 4*b* illustrate a portion of the display panel before and after imaging, respectively, and produced by another embodiment of the invention.
Figure 4B:
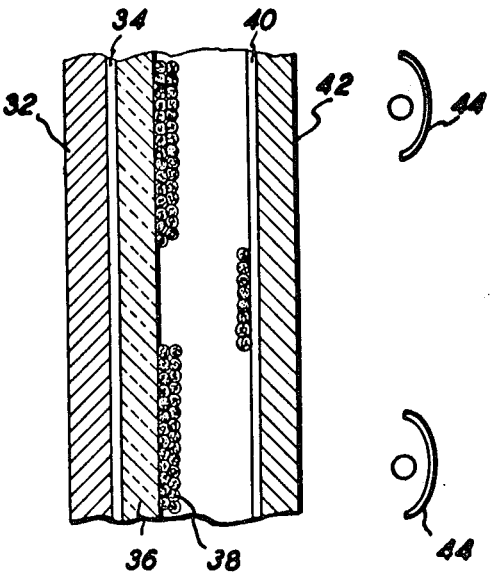

Another embodiment of the image buffer of the present invention is shown in FIG. 4. The circulation system described with reference to FIG. 1 is equally applicable to the image buffer embodiment as shown in FIG. 2. A thin glass sheet 32, transparent to visible light but opaque to ultraviolet light, has a transparent conductive layer 34, initially negatively charged, deposited thereon. A transparent photoconductor 36 which is sensitive to ultraviolet light is deposited upon layer 34. Spaced between layer 36 and a conductive transparent layer 40, initially positively charged, is a dilute liquid developer which contains dark, positively charged particles 38. A preferred arrangement for rear surface imaging would have the dark particles 38 transparent to ultraviolet light.

The initial condition in which particles 38 are deposited on photoconductive surface 36 is shown in FIG. 4(*a*). If the potential difference between the two layers 34 and 40 are now reversed and the photoconductor image exposed, particles 38 will be selectively removed from the front sheet 36 and transported to the surface of layer 40 in the light struck area as shown in FIG. 4(*b*). The resulting image can be viewed by rear illumination utilizing light sources 44 as discussed with reference to the viewing procedure of FIG. 1.

Erasure is accomplished by flooding the rear surface of plate 42 with ultraviolet illumination to which photoconductor 36 is sensitive and applying an alternating potential to the conductive layers of plates 10 and 12. This will redistribute the particles. The illumination can then be turned off and a polarity established between the plates that causes the charged particles to deposit on the photoconductor as initially established.

While the invention has been described with reference to its preferred embodiments, it will be understood by those skilled in the art that various changes may be made and equivalents substituted for elements thereof without departing from the true spirit and scope of the invention. In addition, many modifications may be made to adapt a particular situation or material to the teachings of the invention without departing from its essential teachings.

What is claimed is:

1. A photoelectrophoretic image reproduction device comprising an electrophoretic suspension layer having a dark suspending medium and at least one photosensitive electrophoretic material in a finely divided powder form suspended in said dark suspending medium, said suspension layer having two opposite major surfaces; a substantially transparent first electrode and a second electrode which are spaced from and opposed to each other and are positioned on said two opposite major surfaces of said suspension layer, respectively; means coupled to said electrodes to apply a D.C. electric field across the suspension layer between said electrodes; means operatively associated with said first electrode to expose said suspension layer to an image of actinic electromagnetic radiation through said first electrode, said electric field and said image electrophoretically changing the spatial distribution of said at least one photosensitive electrophoretic material so as to change the optical reflective property of the suspension layer in accordance with said image, whereby an image is reproduced.

2. A photoelectrophoretic image reproduction device as claimed in claim 1 wherein said at least one photosensitive electrophoretic material is a material the charge polarity of which can be changed by application of said D.C. electric field and by exposure to said image.

3. A photoelectrophoretic image reproduction device as claimed in claim 1 wherein said second electrode is transparent.

4. A photoelectrophoretic image reproduction device as claimed in claim 1 wherein said means for applying a D.C. electric field across the suspension layer between said electrodes includes means for controlling said electric field with respect to at least one property selected from the group consisting of strength, and polarity.

5. A photoelectrophoretic image reproduction device as claimed in claim 1 wherein said means to expose said suspension layer to said image includes means to expose the whole of at least one surface of said suspension layer to said actinic electromagnetic radiation for erasing said image which is reproduced.

6. A photoelectrophoretic image reproduction device as claimed in claim 1 wherein said D.C. electric field is applied across the suspension layer at least while said suspension layer is exposed to said image.

7. A photoelectrophoretic image reproduction device as claimed in claim 6 wherein said D.C. electric field is further applied across the suspension layer before said suspension layer is exposed to said image.

8. A photoelectrophoretic image reproduction device as claimed in claim 6 wherein an electric field with reverse polarity with respect to said D.C. electric field is further applied across the suspension layer after removal of said D.C. electric field and said image from said suspension layer.

9. A photoelectrophoretic image reproduction device as claimed in claim 1 further including a housing enclosing said suspension layer.

* * * * *